US007922042B2

(12) United States Patent
Rossignol

(10) Patent No.: US 7,922,042 B2
(45) Date of Patent: Apr. 12, 2011

(54) TILTING FLAP PUMP

(75) Inventor: Eric Rossignol, Chalon sur Saone (FR)

(73) Assignee: Rexam Dispensing SMT S.A. (FR)

( * ) Notice: Subject to any disclaimer, the term of this patent is extended or adjusted under 35 U.S.C. 154(b) by 463 days.

(21) Appl. No.: 12/116,338

(22) Filed: May 7, 2008

(65) Prior Publication Data

US 2008/0277427 A1 Nov. 13, 2008

Related U.S. Application Data

(63) Continuation of application No. PCT/FR2006/002477, filed on Nov. 7, 2006.

(30) Foreign Application Priority Data

Nov. 10, 2005 (FR) ..... 05 53432

(51) Int. Cl.
*B65D 37/00* (2006.01)

(52) U.S. Cl. ..... 222/207; 222/256; 222/321.7; 222/321.9; 222/380; 222/556

(58) Field of Classification Search ..... 222/256, 222/380, 321.7, 556, 321.9, 531, 340, 385, 222/383.1, 209, 257, 259, 534, 630–633, 222/207, 321.1
See application file for complete search history.

(56) References Cited

U.S. PATENT DOCUMENTS

| | | | | |
|---|---|---|---|---|
| 4,696,415 | A | 9/1987 | Meshberg | |
| 4,872,596 | A * | 10/1989 | Corsette | 222/380 |
| 4,890,773 | A * | 1/1990 | Corsette | 222/380 |
| 4,936,493 | A * | 6/1990 | Foster et al. | 222/209 |
| 5,104,009 | A * | 4/1992 | Battegazzore | 222/209 |
| 5,176,510 | A | 1/1993 | Nilsson | |
| 5,492,252 | A | 2/1996 | Gueret | |
| 6,047,862 | A * | 4/2000 | Davies | 222/145.3 |
| 6,460,739 | B1 * | 10/2002 | Norris et al. | 222/380 |

FOREIGN PATENT DOCUMENTS

| | | |
|---|---|---|
| FR | 2510069 | 1/1983 |
| GB | 1262528 | 2/1972 |

OTHER PUBLICATIONS

International Search Report, Mar. 30, 2007, 3 pages.

* cited by examiner

*Primary Examiner* — Frederick C. Nicolas
(74) *Attorney, Agent, or Firm* — St. Onge Steward Johnston & Reens LLC

(57) ABSTRACT

The invention relates to a pump for a liquid product dispenser, which includes a reservoir and interacts with a manually actuatable element provided with an injection orifice. The pump includes a body embodied in the form of a single piece and including a seat which covers the reservoir and is provided with an intake orifice and a flap, which is mounted on the seat by a joint associated with an elastic bellows which enables the flap to be reversibly tilted towards the seat, by pressing on the actuating element, in such way that the injection orifice is opened and the intake orifice is simultaneously closed.

16 Claims, 3 Drawing Sheets

TILTING FLAP PUMP

CROSS-REFERENCE TO RELATED APPLICATIONS

The present application is a continuation of pending International patent application PCT/FR2006/002477 filed on Nov. 7, 2006 which designates the United States and claims priority from French patent application 0553432 filed on Nov. 10, 2005, the content of which is incorporated herein by reference.

FIELD OF THE INVENTION

The present invention relates to a two-component pump liable to equip a dispenser mainly intended for liquid or pasty cosmetics or pharmaceutical products and specifically applies to samples of such products.

BACKGROUND OF THE INVENTION

Conventional dispensers are generally equipped with a reservoir and a pump which interacts with a manually actuatable element of the pushbutton type provided with an ejection orifice.

However, the production cost of such dispensers is very high, because of the complexity of their structure and in particular, of the pump.

Such disadvantage is particularly penalising for applications in the field of samples because the manufacturing costs of a miniature pump are often out of proportion to the marketing requirements of such type of product.

Besides, as regards the packaging of products in an air-intake free (so-called "airless") dispenser, the mechanisms of the conventional atmospheric pumps are inappropriate and do not make it possible to obtain a satisfactory sealing level.

In addition, the end of the ejection orifice is difficult to close in a satisfactory way and the product remains partially in contact with the air, which causes risks of drying and/or deterioration.

In addition, such pumps have a defect in that they include a metallic spring, the contact with the product of which is detrimental or even prohibited.

One object of the present invention is to solve the technical problems resulting from the prior art.

SUMMARY OF THE INVENTION

This aim is reached, according to the invention, with a dispenser characterized in that the pump consists of a body embodied in the form of a single piece comprising on the one hand, a seat which covers said reservoir and is provided with an intake orifice and on the other hand, a flap which is mounted on said seat by means of a joint associated with an elastic return means which enables said flap to be reversibly titled towards the seat by pressing on the actuating element in such a way that the ejection orifice is opened and the intake orifice is simultaneously closed.

According to an advantageous characteristic, said flap carries two sealing plugs for the intake orifice and the ejection orifice, respectively.

According to a first alternative embodiment of the invention, said plugs are made of bosses, the dimensions of which allow a sealing cooperation with the ejection and intake orifices, respectively, Preferably, said plugs are mounted on either side of a triangular link.

Advantageously, said joint is made of a hinge connected to the angle of said link.

According to a specific alternative solution, said hinge is made of a connection nip having a spring effect.

According to another advantageous characteristic, said flap includes a control lever, which the actuating element is liable to come in bearing contact with for causing the tilting thereof.

Preferably, the actuating element is provided with elastic bellows, which form elastic return means for the flap.

According to an advantageous characteristic, such actuating element is made in a single piece with the upper part of the reservoir.

According to another alternative solution, the inner wall of the actuating element carries at least one draw lug for said flap.

In addition, said body includes two side bearings surrounding and/or supporting said flap.

According to still another alternative solution, at least one of said bearings has a longitudinal groove arranged in its inner wall for the passage of said draw lug.

According to another advantageous characteristic still, said seat includes a side sealing skirt, which is radially tightened against the inner wall of the actuating element or of the reservoir.

Preferably, the upper part of the flap has an inclined face facilitating the bearing contact of the actuating element.

The pump of the invention is a reliable and economic technical solutions to the problems met with the packagings of the prior art.

As a matter of fact, such pump can include only two simple structured parts likely to be moulded and assembled in a very easy and quick way which can thus be automated.

In addition, such pump includes only plastic material parts, the compatibility with cosmetic and pharmaceutical products of which is guaranteed.

BRIEF DESCRIPTION OF THE DRAWINGS

Other objects and advantages of the invention will appear upon reading the following description, which is made while referring to the appended drawings, in which.

DETAILED DESCRIPTION OF THE INVENTION

The pump, according to the invention, is intended for packaging and delivering liquid or gel cosmetic or pharmaceutical products and more particularly, samples or small doses of such products.

Figure 1:
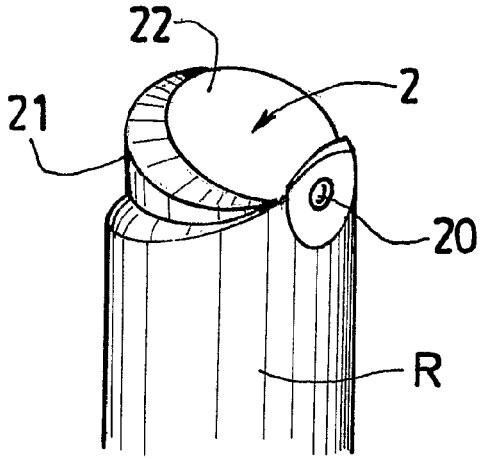
FIG. 1 shows an outside perspective view of a dispenser equipped with an embodied pump according to the invention.

Generally speaking, dispensers for liquid cosmetic or pharmaceutical products include a reservoir R and a pump, at least partially mounted inside the reservoir and cooperating with a manually actuatable element 2 provided with an ejection orifice 20, as shown in the outside view of FIG. 1.

The embodiment of the dispenser according to the invention, such as shown in the Figures, is intended for an airless utilisation.

Consequently, the reservoir R is tightly closed in its lower part by a bottom F which forms a piston, which goes up inside the reservoir when and as the product is delivered while remaining in contact with the product, as shown in FIGS. 4A to 4D.

The pump, according to the invention, consists of a body 1 which is formed in a single piece and which is made for example, by means of an injection moulding method.

Figure 2A:
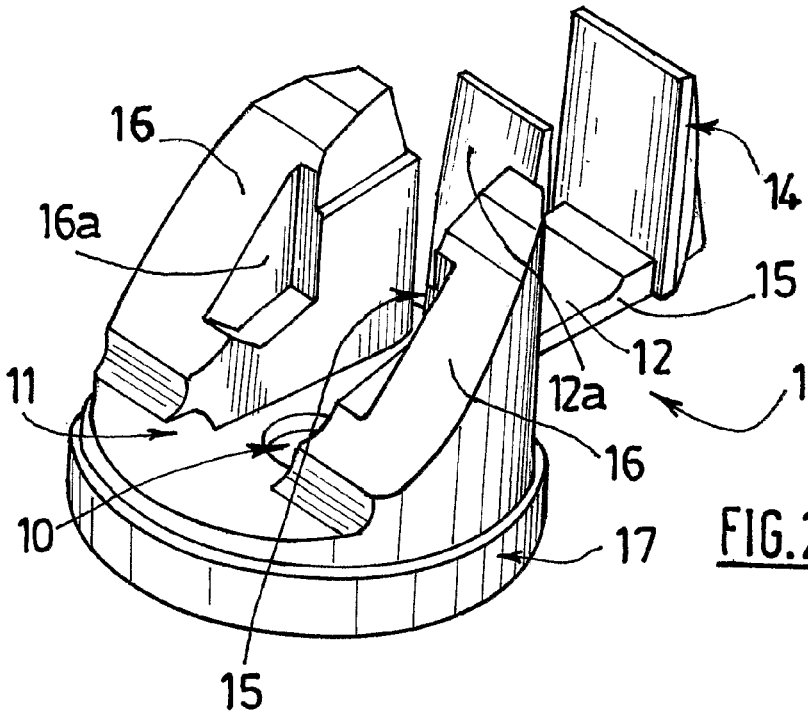
FIGS. 2A and 2B show partial views respectively in perspective and front views of an alternative embodiment of the body of the pump of the invention prior to the mounting thereof.
Figure 2B:
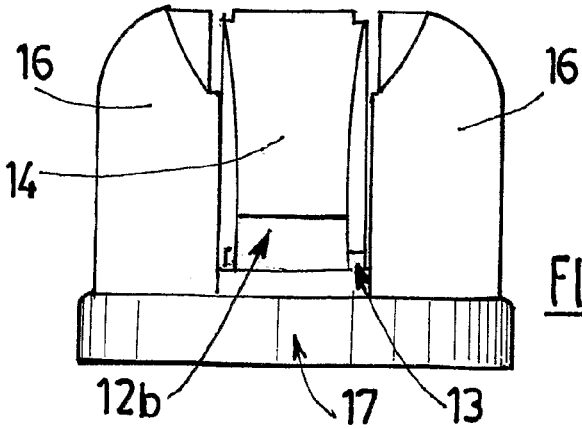

As shown in FIGS. 2A and 2B, when leaving the mould, the body 1 has on the one hand, a seat 11 which covers said reservoir R and provided with an intake orifice 10 and, on the other hand, a single flap 12 connected to said seat by means of a joint, here in the form of a hinge 13.

Figure 3B:
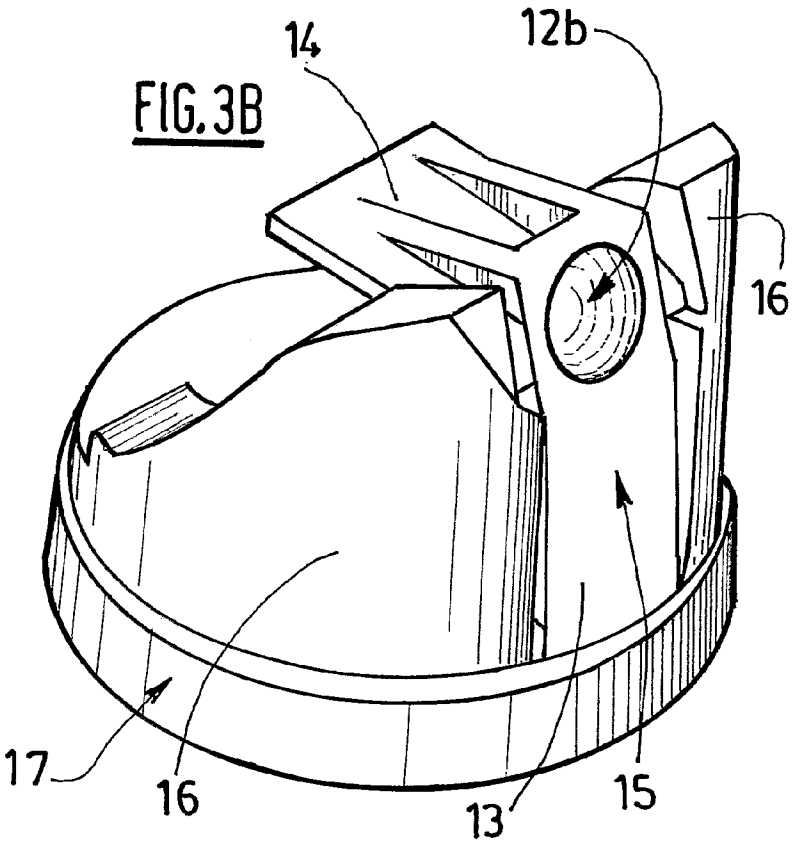
FIGS. 3A and 3B show partial perspective and front views respectively of the alternative solution of the body of the pump of FIGS. 2A and 2B in assembling position.
Figure 3A:
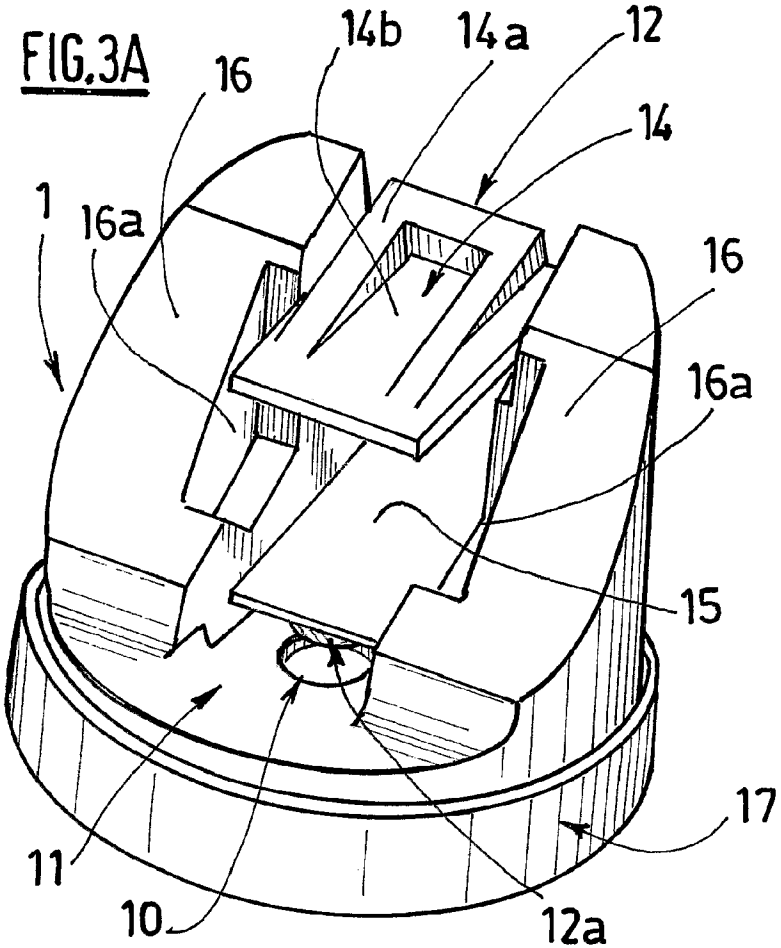

The body 1 is configured, in a subsequent step, in operational position by closing the flap 12 over the seat 11 while maintaining the hinge 13 slightly under a stress, as shown in FIGS. 3A and 3B.

The body 1 is then captured in this configuration under the actuating element 2, in the upper part of the reservoir R.

The seat 11 includes a side sealing skirt 17, which is radially tightened against the inner wall of the actuating element 2 or the reservoir R.

The upper part of the flap 12 includes a control lever 14 which the actuating element 2 is liable to come in contact with for causing its forced tilting downwards, from a sealing closure position of the ejection orifice 20.

Such tilting, which is reversible, causes the opening of the ejection orifice 20 and the simultaneously closing of the intake orifice 10.

The lever 14 has an inclined face 14*a* which facilitates the bearing contact of the actuating element 2. The face 14*a* is possibly provided with a central cavity 14*b*, as shown, more particularly in FIGS. 3A and 3B, with a view to limiting the effects resulting from the shrinkage of the plastic material while it cools after the moulding operation.

The hinge 13 is made of a transversal nip or a thin web.

The single flap 12 carries two sealing plugs of the intake orifice 10 and the ejection orifice 20, respectively.

Such plugs are made of bosses 12*a*, 12*b*, here in the form of spherical caps, the dimensions of which and more particularly, the diameters of which enable a sealing cooperation with the ejection orifice and intake orifice, respectively and which are mounted on either side of a triangular link 15.

The link 15 is connected at its angle (here an angle of approximately 90°) to the connection nip forming said hinge 13.

The body 1 includes two bearings 16 surrounding said flap 12 and providing the side wedging thereof.

According to an alternative solution not shown, the joint of the flap is provided in the form of pivots supported by the side bearings.

Figure 4A:
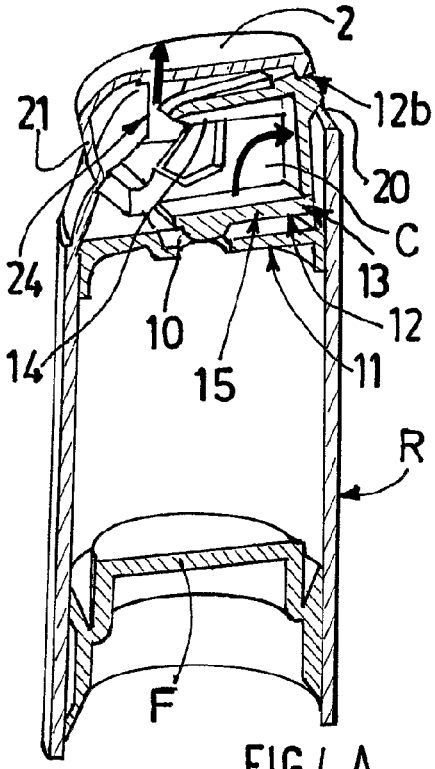
FIGS. 4A to 4D show sectional views of the embodiment of FIG. 1 and various rest and utilisation positions.
Figure 4B:
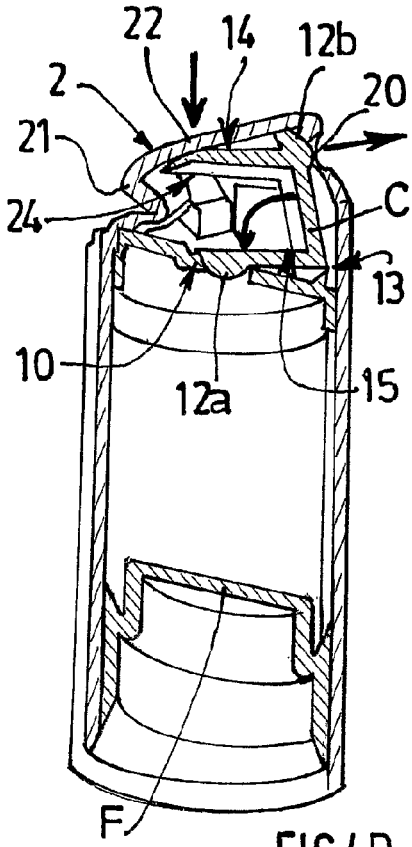

As shown in FIGS. 1 and 4A to 4B, the actuating element 2 has an upper face 22 for the manual pressing, and is provided with an elastic return means for the flap, here in the form of elastic bellows 21 having a spring effect, which is made on the side wall and provides the connection to the reservoir R.

In the embodiment shown, the actuating element 2 is made in a single piece with the upper part of the reservoir R.

FIGS. 4A to 4D show a section view of a dispenser provided with a pump according to the invention during the various phases of operation.

In the rest position in FIG. 4A, the draw lugs 24 connected to the inner wall of the upper face 22 of the actuating element 2 are resting under the control lever 14 and pull it upwards by means of the action of the bellows 21, having a spring effect, and the link 15 of the flap 12 is returned towards the hinge 13 on the right, in the direction of the arrow.

According to an optional alternative embodiment, the hinge 13 can facilitate or provide the elastic return of the flap 12 in the position of a sealing closure of the ejection orifice 20 like a spring having a shape memory or in addition to or instead of the bellows 21.

The plug 12*b* is then sealingly engaged into the ejection orifice 20 like a plug on a bottle, whereas the intake orifice 10 is opened.

In this position, when the priming is completed (for example in the factory), the compartment C located between the seat 11 and the inner face of the actuating element is filled with a liquid product and becomes a dosing chamber.

Figure 4C:
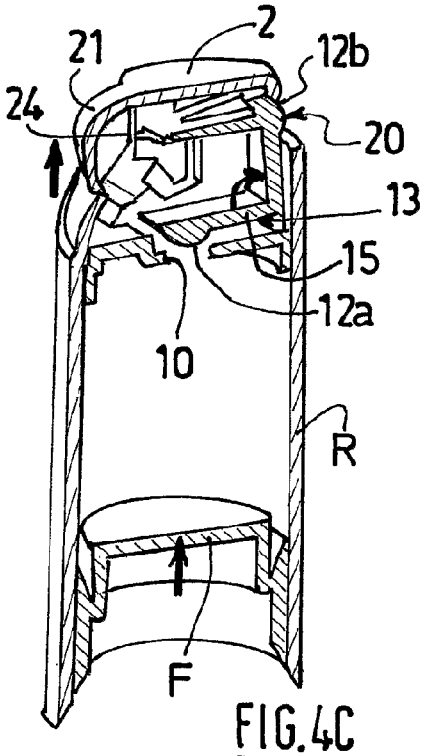

The actuating element 2 has, in this example, at least one and preferably, two symmetrical draw lugs 24 for pulling the control lever 14 of the flap 12 upwards through the action of the bellows 21 and thus make it possible to provide the sealing closure of the ejection orifice 20 in the rest position of the dispenser (the arrow in FIG. 4A) and then to facilitate the return of the flap 12 in this same rest position, when the manual pressing stops (arrow in FIG. 4C).

For this purpose, at least one and, here, both bearings 16 of the seat 11 has/have a longitudinal groove 16*a* provided on the inner wall for the passage of the draw lugs 24.

In the position shown in FIG. 4B, the user manually presses in the direction of the arrow on the upper part of the actuating element 2.

Upon completion of an ineffective stroke resulting from the discrepancy between the pressing face of the draw lugs 24 and the inner wall of the upper face 22, such pressing brings the wall of the element 2 in contact with the control lever 14 of the flap 12 which causes the forced tilting of the link 15 downwards towards the seat 11 in the direction of the arrow.

Such movement releases the ejection orifice 20 whereas the plug 12*a* closes the intake orifice 10.

At the same time, such pressing also causes the compression of the bellows 21 and the reduction in the volume of chamber C, which leads to the release of a dose of a pressurised product towards the outside through the ejection orifice 20 (grey arrow).

Such dose substantially corresponds to the volume of the product delivered during the tilting stroke of the flap 12 until the plug 12*a* abuts against the orifice 10.

In the position shown in FIG. 4C, the user releases the pressing which causes the release of the bellows 21 and the return of the link 15 rightwards in the direction of the arrow because of the shape memory of the bellows 21.

The reverse tilting of the flap 12 is carried out by the lugs 24, which are also pulled upwards by the bellows 21.

Such motion of the flap 12 leads to the closing of the ejection orifice 20, the simultaneous opening of the intake orifice 10 and because of the absence of air intake, the simultaneous up motion of the piston bottom F in the reservoir R when in contact with the product.

Figure 4D:
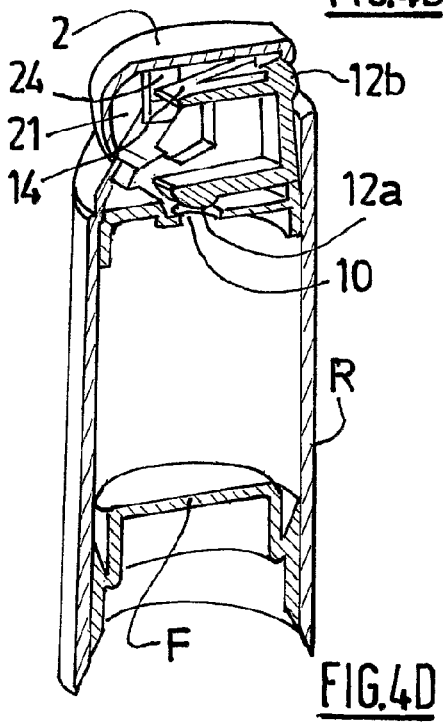

The intake orifice 10 being opened, the chamber C is refilled by means of a suction effect until an equilibrium is obtained in the new rest position as shown in FIG. 4D.

What is claimed is:

1. A pump for a liquid product dispenser which comprises a reservoir and interacts with a manually actuatable element provided with an ejection orifice, characterized in that said pump consists of a body embodied in a form of a single piece and comprising a seat which covers said reservoir and is provided with an intake orifice and a flap which is mounted on said seat by means of a joint associated with an elastic return means which enables said flap to be reversibly tilted towards said seat by pressing on the actuating element in such a way that the ejection orifice is opened and the intake orifice is simultaneously closed.

2. The pump according to claim 1, characterized in that said flap carries two tight plugs for the intake orifice and the ejection orifice, respectively.

3. The pump according to claim 1 , characterized in that said plugs are made of bosses , the dimensions of which enable a tight cooperation with the ejection and intake orifices, respectively.

4. The pump according to claim 2 , characterized in that said plugs are mounted on either side of a triangular link.

5. The pump according to claim 4, characterized in that said joint is made of a hinge connected to the angle of said link.

6. The pump according to claim 5, characterized in that said hinge is made of a connection nip with a spring effect.

7. The pump according to claim 1, characterized in that said flap includes a control lever which the actuating element is liable to come in bearing contact with for causing the tilting thereof.

8. The pump according to claim 1 , characterized in that said actuating element is provided with elastic bellows which form elastic return means for the flap.

9. The pump according to claim 1 , characterized in that the actuating element is made in a single piece with the upper part of the dispenser reservoir.

10. The pump according to claim 1 , characterized in that the inner wall of the actuating element carries at least a draw lug of said flap.

11. The pump according to claim 10, characterized in that said body includes two side bearings surrounding and/or supporting said flap.

12. The pump according to claim 11, characterized in that at least one of said bearings has a longitudinal groove arranged on the inner wall thereof for the passage of said draw lug.

13. The pump according to claim 1, characterized in that said seat includes a side sealing skirt which is radially tightened against the inner wall of the actuating element or the reservoir.

14. The pump according to claim 1, characterized in that the upper part of the flap has an inclined face which facilitates the bearing contact of the actuating element.

15. The pump according to claim 2, characterized in that said plugs are made of bosses, the dimensions of which enable a tight cooperation with the ejection and intake orifices, respectively.

16. The pump according to claim 3, characterized in that said plugs are mounted on either side of a triangular link.

* * * * *